US007304608B2

(12) United States Patent
Lin

(10) Patent No.: US 7,304,608 B2
(45) Date of Patent: Dec. 4, 2007

(54) WIRELESS NETWORK APPARATUS AND ADAPTIVE DIGITAL BEAMFORMING METHOD THEREOF

(75) Inventor: Ching-Lang Lin, Hsinchu (TW)

(73) Assignee: Accton Technology Corporation, Hsinchu (TW)

( * ) Notice: Subject to any disclaimer, the term of this patent is extended or adjusted under 35 U.S.C. 154(b) by 0 days.

(21) Appl. No.: 11/212,719

(22) Filed: Aug. 29, 2005

(65) Prior Publication Data

US 2007/0046538 A1 Mar. 1, 2007

(51) Int. Cl.
*H01Q 3/00* (2006.01)

(52) U.S. Cl. ..... 342/377; 342/372

(58) Field of Classification Search ..... 342/377, 342/372

See application file for complete search history.

(56) References Cited

U.S. PATENT DOCUMENTS 6,633,265 B2 * 10/2003 Hirabe ..... 342/372
6,965,658 B1 * 11/2005 Lindqvist et al. ..... 375/347
7,016,399 B1 * 3/2006 Vadgama et al. ..... 342/373
2005/0184906 A1 * 8/2005 Nakaya et al. ..... 342/377

* cited by examiner

*Primary Examiner*—Thomas H. Tarcza
*Assistant Examiner*—Fred H Mull
(74) *Attorney, Agent, or Firm*—Bacon & Thomas, PLLC

(57) ABSTRACT

A wireless network apparatus, comprising a weighting device. The weighting device, includes a weight generator, and an algorithmic unit, and is for receiving and multiplying digital input signals from an antenna by a weight vector to output a digital weighted signal. The invention searches for the location of the client by detecting its signal strength and moving the main beam generated by the antenna array towards the client using an adaptive digital beamforming method according to proposed algorithms. The method searches for a client by: first, searching a main central angle C; then, determining a weight vector in response to the main central angle C; fine-tuning the main central angle C; and forming a main beam according to the fine-tuned main central angle and the weight vector.

14 Claims, 9 Drawing Sheets

WIRELESS NETWORK APPARATUS AND ADAPTIVE DIGITAL BEAMFORMING METHOD THEREOF

BACKGROUND OF THE INVENTION

1. Field of the Invention

The invention relates in general to a wireless network apparatus, and more particularly to a wireless network apparatus and an adaptive digital beamforming method thereof.

2. Description of the Related Art

Given the increasing demand for high data rate traffic, the need for very efficient wireless data communication systems has become increasingly important. Smart antenna systems have therefore been proposed with beamforming techniques for decreasing interferences and overcoming signal fading due to multipath propagations.

FIG. 1 shows architecture of an archetypical smart antenna system equipped with analog beamformers. The smart antenna system 100 has an antenna array 110 with n+1 antennae capable of generating a multi-beam pattern 112. Signals from remote units (not shown), such as from network clients, that are each assigned with a distinct media access control (MAC) ID, MAC101-n, are then detected and received by the antenna array when falling within a coverage area defined by the beam pattern. An analog beamformer 120 is then arranged to "weight" the incoming signals, i.e. to apply appropriate phase shifting and amplitude scaling such that the incoming signals are reconstructed. The weight adjusted incoming signals are provided to transceiver 130, which filter the signals. The filtered signals from the transceiver 130 are provided to an AD/DA converter 140 to convert the filtered signals into digital format. The converted digital signals are then provided to a MAC device 150.

However, conventional smart antenna systems equipped with analog beamformers require a complex architecture and consumes considerable power, and is therefore not suitable for compact portable network-capable devices.

SUMMARY OF THE INVENTION

It is therefore an object of the invention to provide a wireless network apparatus and an adaptive beamforming method thereof with digital implementation that resolves the aforementioned problems.

The invention achieves the above-identified object by providing a wireless network apparatus. The wireless network apparatus includes an antenna array, a transceiver, an A/D converter, a weighting device, and a MAC device. The antenna array includes a plurality of antennae. The transceiver receives a plurality of analog input signals from a client via the antennae, and the A/D converter converts the analog input signals into digital input signals. The weighting device, includes a weight generator, and an algorithmic unit, and is for receiving and multiplying the digital input signals by a weight vector to output a digital weighted signal. The weight generator includes a searching unit, a radio pattern unit, and a track unit, and is for generating a weight vector w, which includes a plurality of weights corresponding to the digital input signals from the antenna array. The searching unit determines a main central angle in response to the digital input signals. The radio pattern unit determines the weight vector in response to the main central angle. The track unit fine-tunes the main central angle. The algorithmic unit then multiplies the digital input signals by the weight vector w to generate the digital weighted signal. Finally, a MAC device, connected to the weighting device, processes the digital weighted signal.

The invention achieves the above-identified object by also providing an adaptive digital beamforming method. The method includes searching a main central angle C by respectively forming a plurality of beams with different central angles. A signal strength of incoming signals at each beam is thereafter calculated, and the central angle C of the beam that has the largest signal strength is chosen as the main central angle. Then, a weight vector is determining in response to the main central angle C by looking up a predetermined table. Next, the main central angle is fine-tuned by detecting a signal strength of incoming signals. Finally, a main beam is formed according to the fine-tuned main central angle and the weight vector.

Other objects, features, and advantages of the invention will become apparent from the following detailed description of the preferred but non-limiting embodiments. The following description is made with reference to the accompanying drawings.

DETAILED DESCRIPTION OF THE INVENTION

Figure 1:
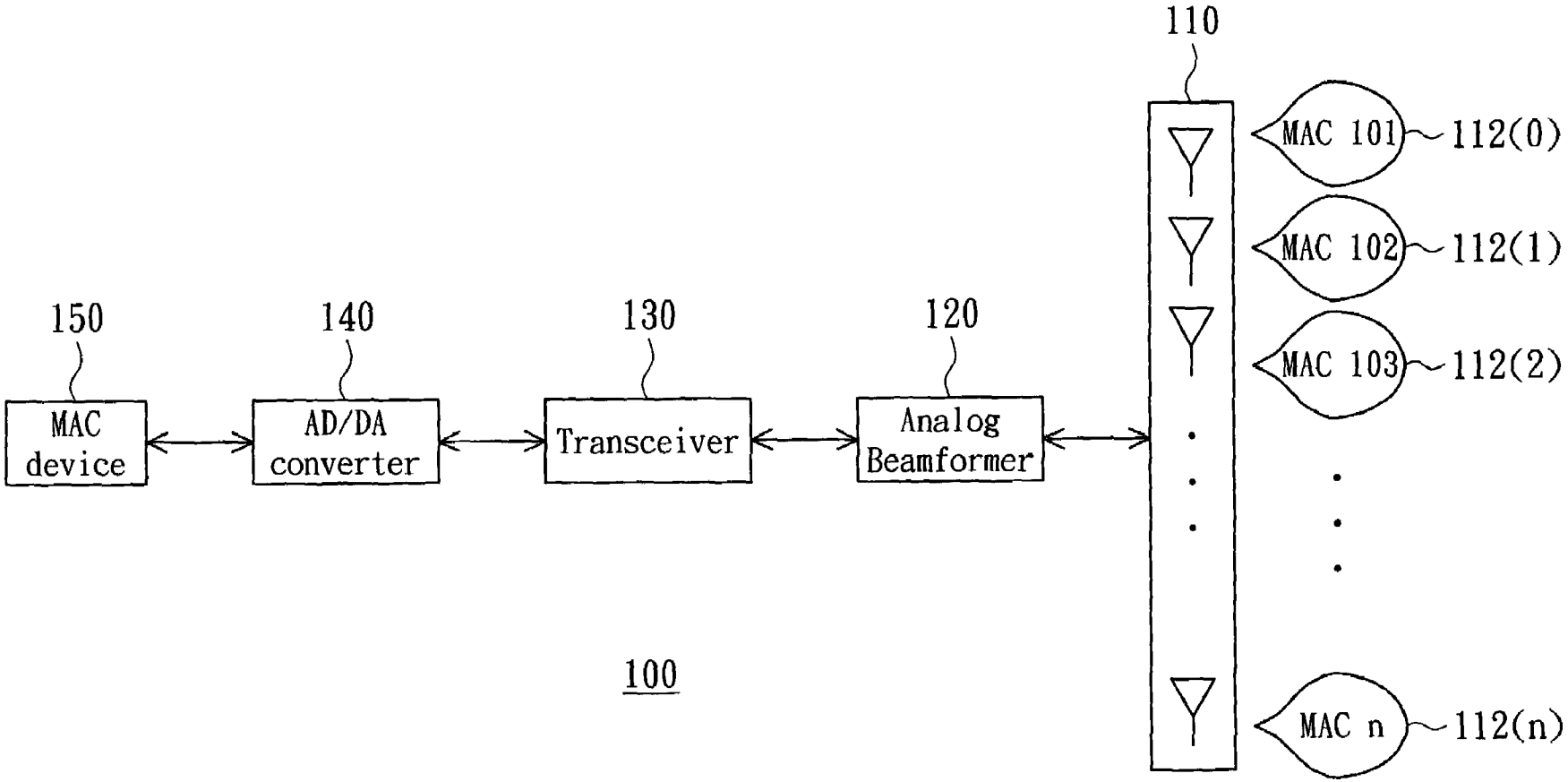
FIG. 1(PRIOR ART)
FIG. 1 shows architecture of an archetypical smart antenna system equipped with analog beamformers.
Figure 2:
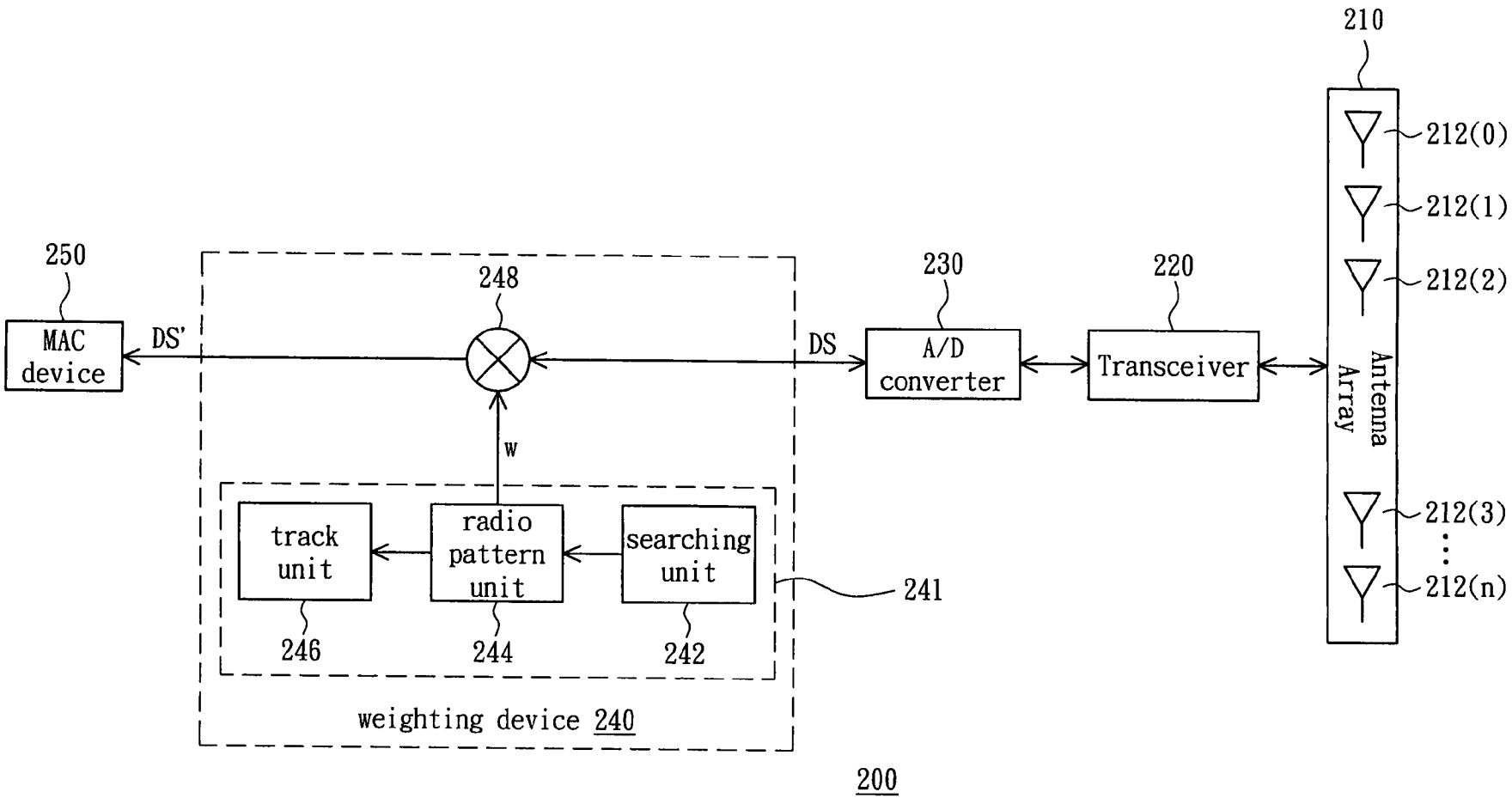
FIG. 2 shows a wireless network apparatus 200 according to a preferred embodiment of the invention.
Figure 3:
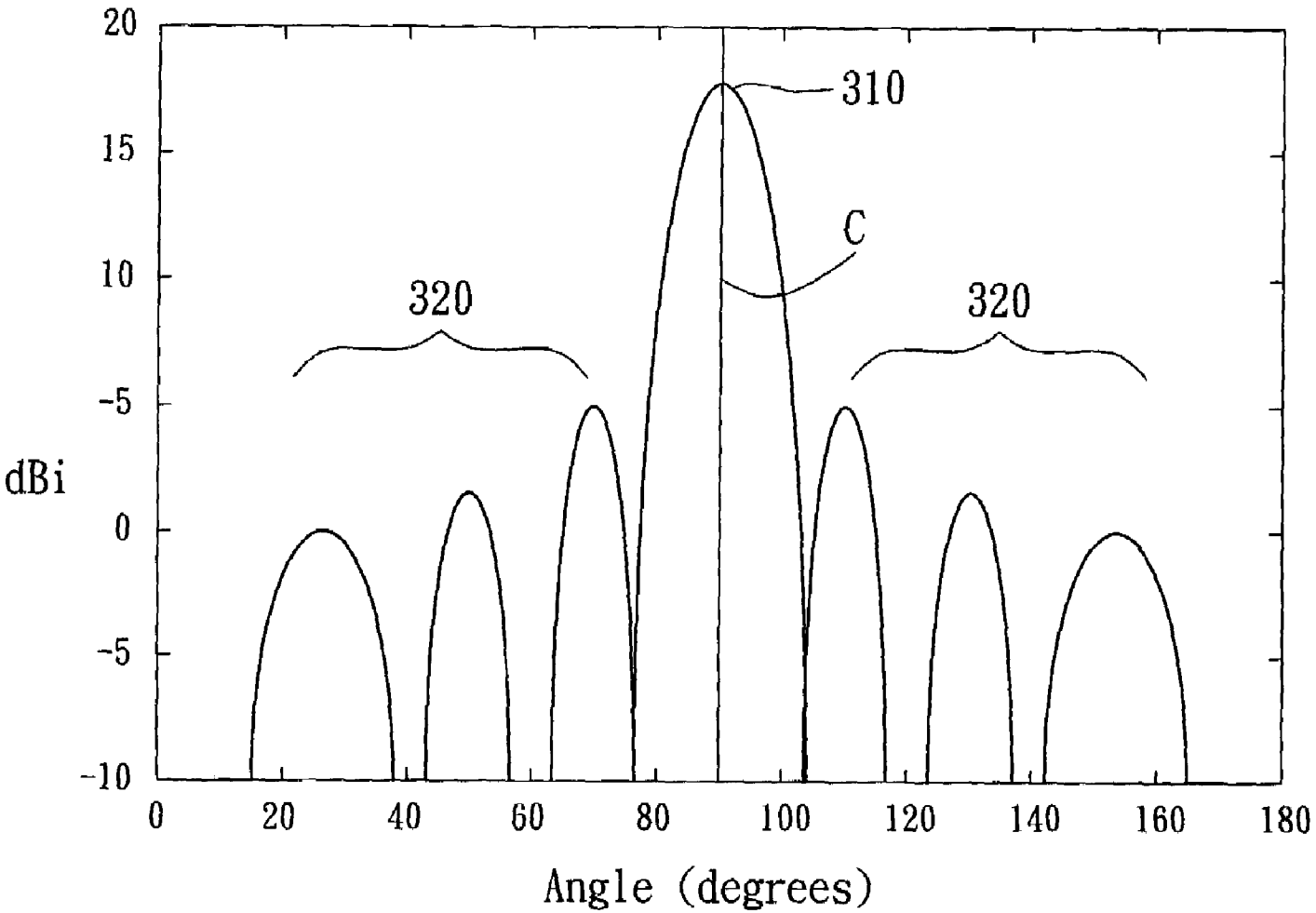
FIG. 3 shows illustration of a beam pattern having a main beam and a plurality of side beams in rectangular form.

FIG. 2 shows a wireless network apparatus 200 according to a preferred embodiment of the invention. The wireless network apparatus 200 includes an antenna array 210 having n+1 antennae 212, including 212(0)-212(*n*), a transceiver 220, an A/D converter 230, a weighting device 240, and a MAC device 250. The antennae of the antenna array 210 together form a multibeam radio pattern, such as one shown in FIG. 3, illustrating a beam pattern having a main beam 310 and a plurality of side beams 320 shown in rectangular form. The main beam 310 has a central angle C. The transceiver 220 receives a plurality of analog input signals from a client (not shown) via the antennae of the antenna array 210. The A/D converter 230 converts the analog input signals into digital input signals. The weighting device 240 includes an algorithmic unit 248 and a weight generator 241. The weight generator 241 generates a weight vector w, which includes weights $w_0$-$w_n$, respectively corresponding to the digital input signals from antenna array 210. The algorithmic unit 248 multiplies the digital input signals by the weight vector w to generate the digital weighted signal DS' to the MAC device 250.

The weight generator 241 includes a searching unit 242, a radio pattern unit 244, and a track unit 246, and is for generating the weight vector w. That is, the searching unit 242 determines a main central angle C in response to the digital input signals DS of the client. From there, the radio pattern unit 244 determines the weight vector w in response to the main central angle C. The track unit 246 then fine-tunes the main central angle C.

The digital input signal DS can be represented mathematically as a complex phasor having a real part i(t) and an imaginary part q(t). The real part i(t) represents positive frequencies of the input signal relative to a channel center frequency. The imaginary part q(t) represents negative frequencies of the input signal relative to a channel center frequency. Together, a digital input signal DS can be expressed as:

$$s(t)=x(t)+j\times y(t); \tag{1}$$

where s(t)=DS, x(t)=i(t) and y(t)=−q(t), and $j=\sqrt{(-1)}$.

To perform weight shifting, taking the 0th antenna 212(0) of the antenna array 210 for instance, the real and imaginary components $x_0(t)$ and $y_0(t)$ of the digital input signal $s_0(t)$ associated with the 0th antenna 212(0) is multiplied by a complex weight $w_0$ to apply proper phase shifting and amplitude scaling. The weight multiplication is performed on all digital input signals associated with all the antennae 212(0)-212(*n*), and the results are summed, to output a digital weighted signal DS'. The MAC device 250 then receives the digital weighted signal DS' to recover information therefrom.

Below, the weight vector is further discussed in detail. The weight vector w includes complex weight $w_0$-$w_n$, representing the complex weight for antennae 212(0)-212(*n*). The weight for an ith antenna of the n antenna array 210 can be expressed as:

$$w_i=a_i\times e^{j\theta_i} \tag{2}$$

which can also be expressed in complex phasor $w_i=a_i\times\cos\theta_i+j\times a_i\times\sin\theta_i$; where i less than or equal to n, where n is a whole number, where $a_i$ is the relative amplitude of the complex weight $w_i$; $\theta_i$ is the phase shifting of the ith antenna, and is the angle $\theta_0$ of arrival (incident angle $\theta_0$) of incoming signals being received at the 0th antenna plus phase difference $i\times\Delta\phi$:

$$\theta_i=\theta_0+i\times\Delta\phi \tag{3}$$

Figure 4:
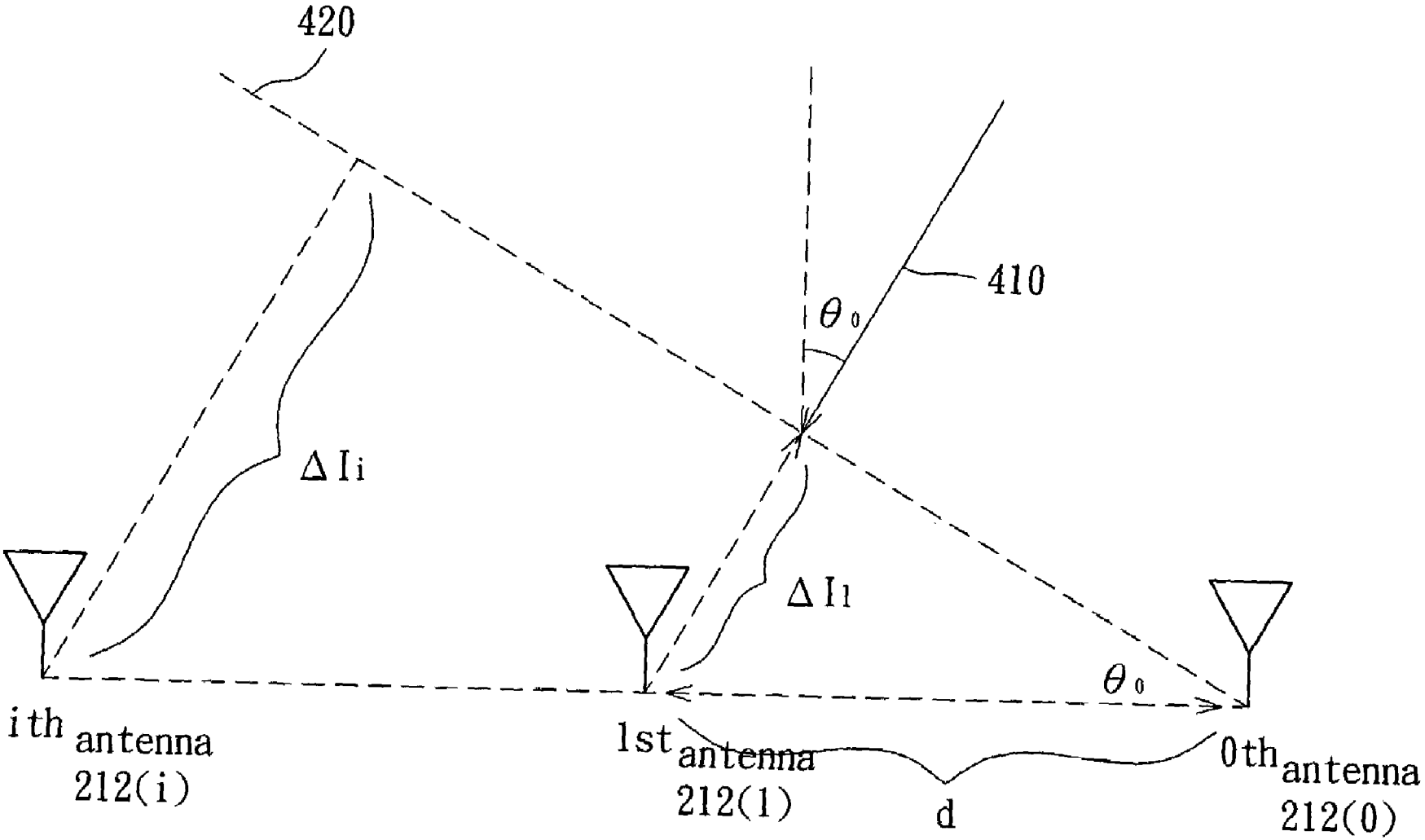
FIG. 4 shows illustration of an angular definition of the angle $\theta_0$ of arrival of an input signal.

FIG. 4 illustrates angular definition of the angle $\theta_0$ of arrival (incident angle $\theta_0$) of an input signal 410. The incoming signal 410 has a wave front 420 arriving first at the 0th antenna 212(0) from direction $\theta_0$. Then, after traveling an extra path distance, $\Delta I_1$, the incoming signal arrives at the 1st antenna 212(1). The path difference $\Delta I_1$ results in a phase difference $\Delta\phi$ between the 0th and the 1st antenna:

$$\Delta\Phi=\frac{2\pi\times\Delta l_1}{\lambda}=\frac{2\pi\times d\times\sin\theta_0}{\lambda} \tag{4}$$

wherein $\Delta I_1=d\times\sin\theta_0$, and λ (lambda) is the wavelength of channel center frequency. By re-arranging the above phase difference equation, an incoming signal generated from a remote station by a client can thus be located via radio source direction-finding approach i.e. by calculating the arrival angle $\theta_0$ at the 0th antenna of the incoming signal from the phase difference $\Delta\phi$:

$$\theta_0=\sin^{1}\left(\frac{\Delta\Phi\times\lambda}{2\pi\times d}\right) \tag{5}'$$

Figure 5:
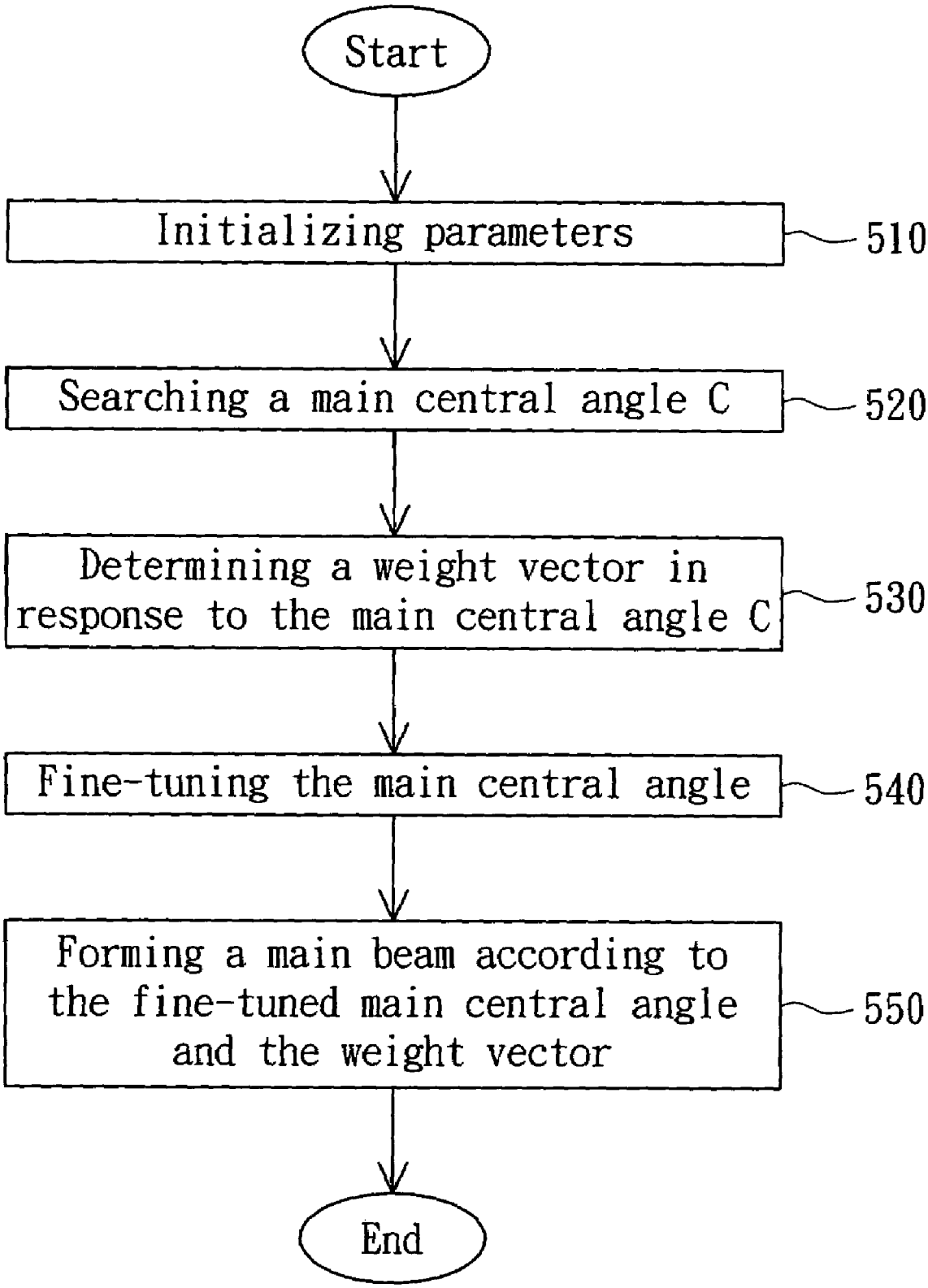
FIG. 5 shows a flow chart illustrating an adaptive digital beamforming method applied to the wireless network apparatus 200.

FIG. 5 shows a flow chart illustrating an adaptive digital beamforming method applied to the wireless network apparatus 200. The adaptive digital beamforming method is applied to adjust an antenna array disposed on a surface, such as a plane, to locate desired incoming signals associated with a client. The method begins at step 510, in which a plurality of parameters are initialized, including setting amplitudes of the beams and the default signal strength etc, and will be discussed later in detail. Then, step 520 is performed by the searching unit 242 to determine a main central angle C of a main beam that covers the client.

In response to the main central angle C, the radio pattern unit 244 determines a weight vector by looking up a predetermined table, as indicated by step 530. To better optimize the signal strength, the track unit 246 further fine-tunes the main central angle C by detecting a signal strength of the desired incoming signal, as shown in step 540. Upon optimizing the signal strength, a main beam is formed according to the fine-tuned main central angle and the weight vector, as shown in step 550.

Figure 6:
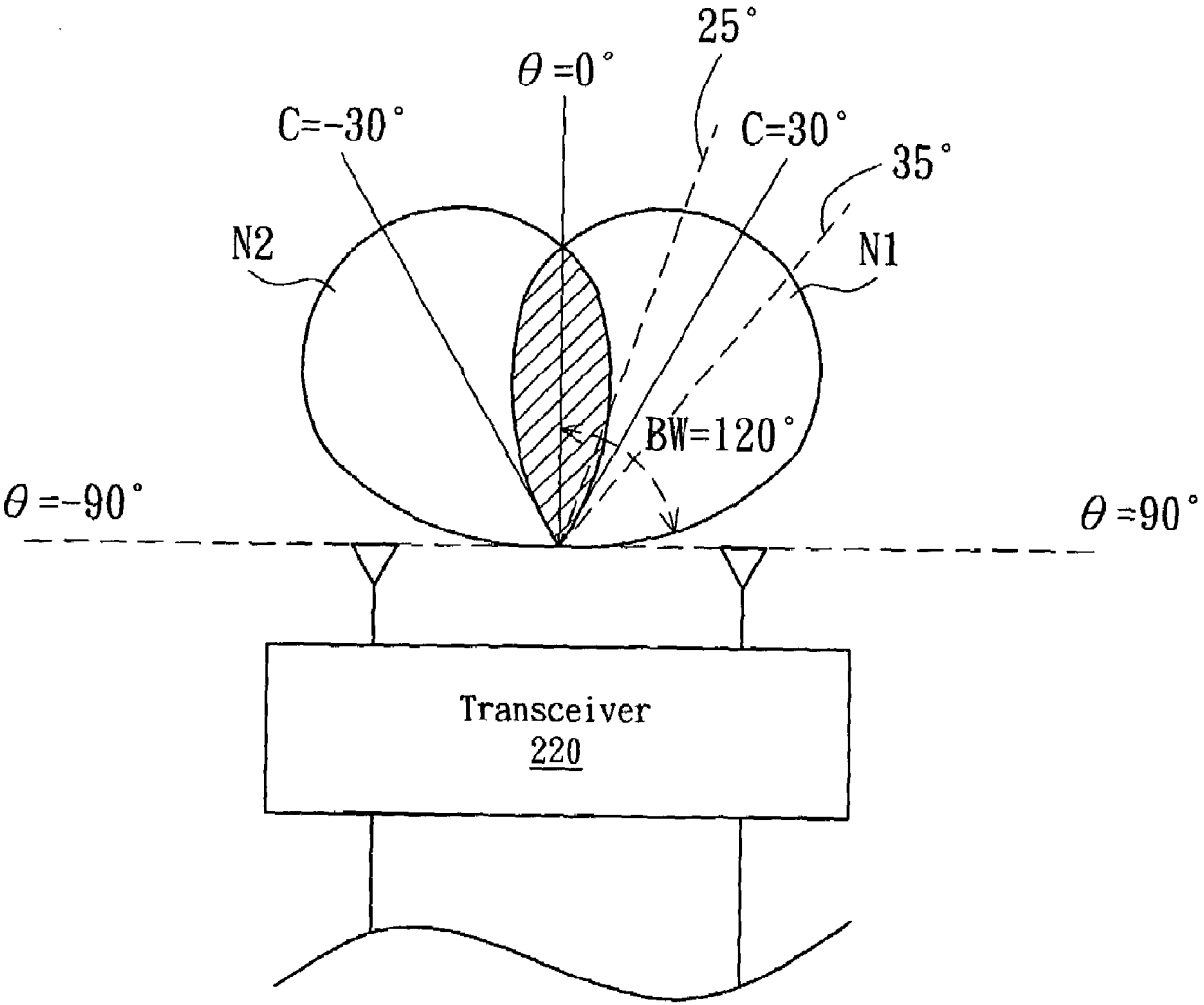
FIG. 6 shows a coverage area of an antenna array 110 in the front plane.

To form the coverage area, the antenna array 210 of FIG. 2 generates beams that can be arranged to orient in directions that spans the plane. That is, the antenna array 210 generates beams that produce a 360 degrees azimuthal field that is divided into a front plane and a back plane. FIG. 6 shows a coverage area of an antenna array 110 in the front plane. The front plane is in turn divided into N locations of coverage defined by the beams, such as N1 and N2. Each beam has a bandwidth BW, 120° for instance, and an overlap area (shaded region) for signal hand-off. For the sake of illustration, the beams in FIG. 6 are illustrated as being adaptive mainbeams; however, the antenna array 210 can also generate multibeam patterns having a mainbeam and multiple side beams, such as one shown in FIG. 3.

Referring back to FIG. 5, in step 510, before the plurality of beams are formed to determine a main central angle C, the beam width BW, along with other parameters such as the initial weight vector and the default signal strength $RSSI_0$ are determined.

To determine a main central angle in step 520, in the preferred embodiment of the invention, the location of the beams are switched among N different locations in the coverage area defined by the antenna array 210 until the largest signal strength of the incoming signals is located. The N different locations correspond to N number of the main beams required to cover all incoming signals in the coverage area, such as N equal to 2 (N1 and N2) as shown in FIG. 6. N is determined by dividing the beam width BW of the main beam by a surface angle to yield a quotient, and rounding off the quotient to a larger one of two nearest integers. Preferably, the surface is a plane. Thus, when the surface angle is 180 degrees in case of a plane, and when the beam width is 120 degrees, N equals to 180/120=1.5, and rounding off N to the larger of the two nearest integers (1 and 2) gives N=2. As illustrated in FIG. 6, the plane is defined by a Cartesian plane coordinate system having a horizontal axis parallel to the plane, and a vertical axis normal to the plane. The positive horizontal axis is at +P (90) degrees, and the negative horizontal axis is at −P (90) degrees, and the positive vertical axis is at 0 degrees. The central angle C of the main beam is thus determined by $$C = P - (n+1) \times \frac{BW}{2} \quad (6)'$$

where n are integers less then or equal to (N−1) (note: n here is not affiliated with the "n" antennae. Hence, in the example of FIG. 6, for P=90°, N=2, and BW=120°, then n=0 and 1. Then, from (6), C can be calculated to be 30° and −30° for n=0 and n=1 respectively corresponding to locations of coverage N1 and N2. The concept will become apparent as the steps involved in the adaptive digital beamforming method are discussed further in detail.

Figure 7:
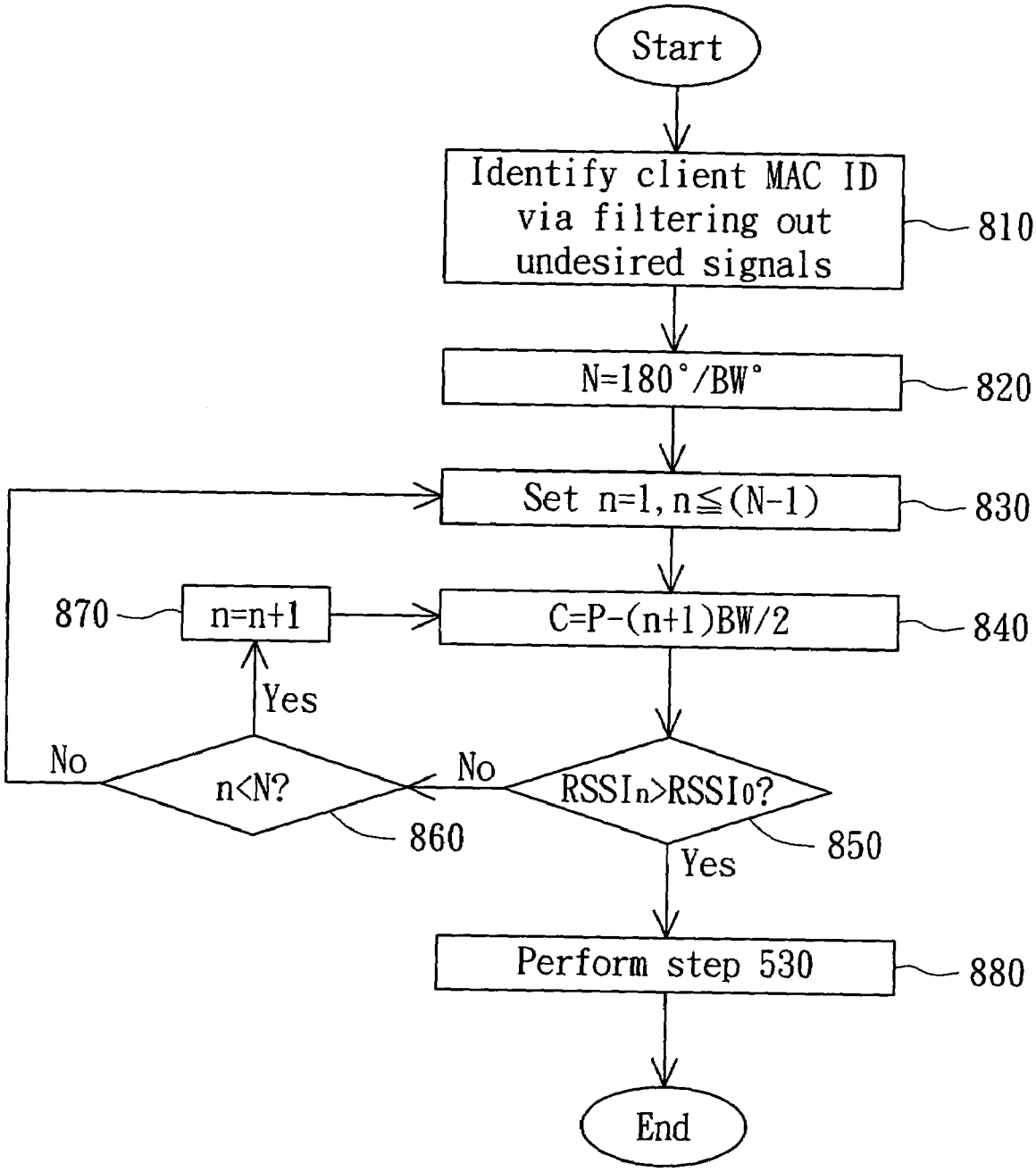
FIG. 7 shows a flow chart of the step of 520 for searching the main central angle.

FIG. 7 shows a flow chart of searching the main central angle of step 520. First, a client MAC ID associated with the desired incoming signal is identified via filtering out the incoming signals that are undesired in step 810. Then, step 820 is performed to determine a value for N by dividing the surface angle, determined during the step 510 of initializing, by the beam width BW (N=surface angle/BW). Then, in step 830, the initial value for n is set to 1, where n≦(N−1). In step 840, the central angle is thereafter calculated:

$$C = P - (n+1) \times \frac{BW}{2},$$

and the central angle C of the main beam is moved to the calculated central angle C, such as to C=30 degrees shown in FIG. 6. Then, step 850 is performed to check whether the signal strength of the incoming signals detected at the calculated central angle C using the determined $RSSI_n$ is greater than the default signal strength $RSSI_0$ of the desired incoming signal: if yes, step 880 is performed, else step 860 is performed. In step 880, step 530 is performed to determine a weight vector in response to the main central angle.

In step 860, it is determined whether n is less than N: if yes, step 870 is performed, else step 830 is returned to.

In step 870, n is incremented by 1 and then step 840 is returned to for calculating a new central angle C of the main beam using the incremented n, and moving the central angle C of the main beam to the new central angle C. Referring to FIG. 6, if the signal strength of the incoming signals relating to the client detected at main central angle C=30 degrees is not greater than the default signal strength $RSSI_0$(step 850), then the coverage is switched from location of coverage N1 to N2 by performing step 840, and move the mainbeam i.e. the main central angle to C=−30 degrees to further search for the client, and the main central angle C is repeatedly switched until the client is found.

Figure 8:
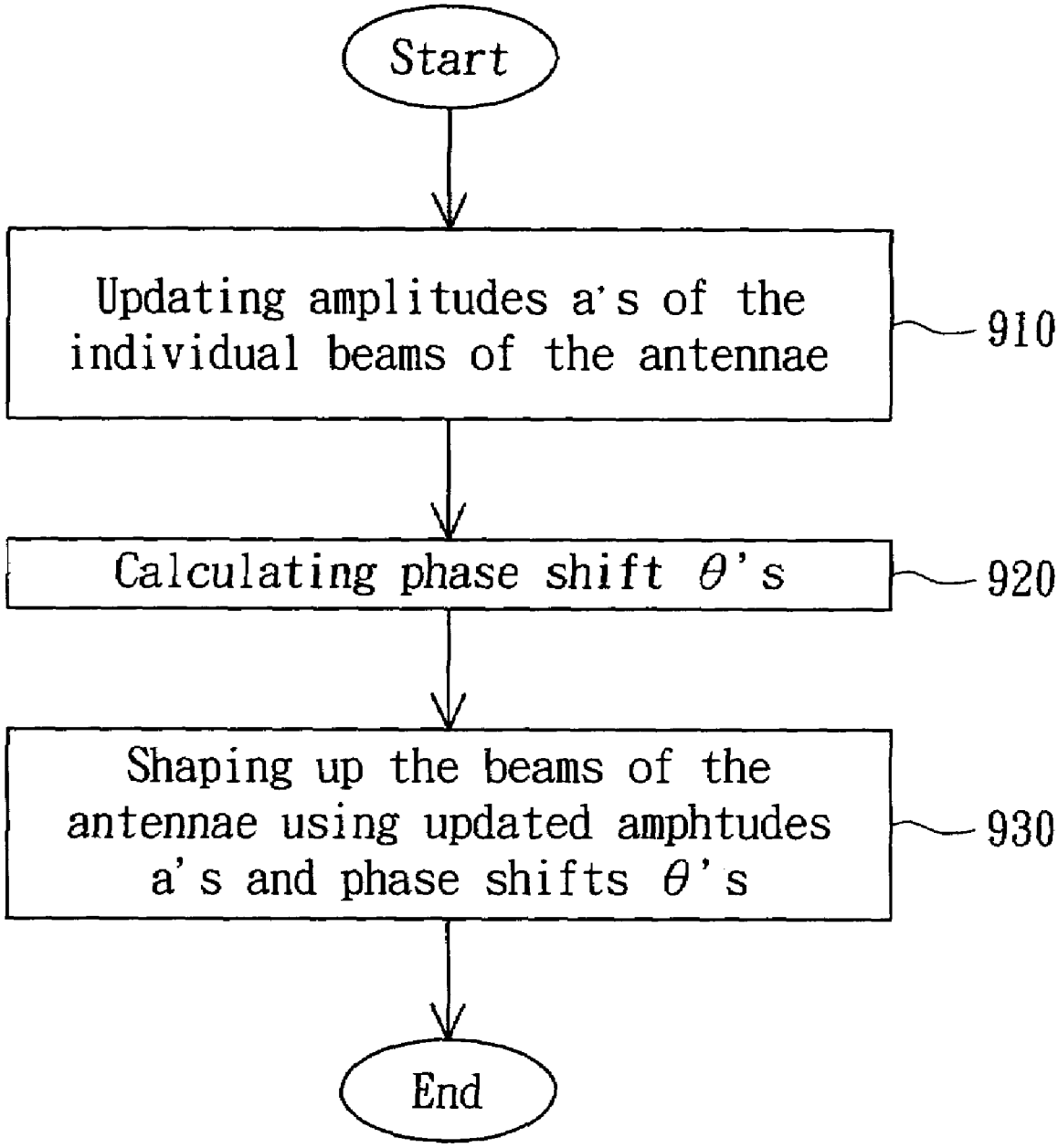
FIG. 8 shows a flow chart illustrating the sub-steps of step 530 to determine a weight vector in response to the main central angle.

After the sub-steps of 520 determines a main central angle C, the step 530 of determining a weight vector is performed to update the plurality of beams generated by the antenna array and nullify undesired incoming signals to improve the signal strength RSSI of the desired incoming signal. FIG. 8 shows a flow chart illustrating the sub-steps of step 530. In response to the largest signal strength RSSI located, the amplitudes a's of the weight vector are updated, as shown in step 910. Also, the phases θ's of the weight vector are updated, as indicated by step 920. Finally, step 930 is performed for shaping up the plurality of beams of the respective antennae of the antenna array using the updated weight vector by applying appropriate phase shifting and amplitude scaling.

Figure 9:
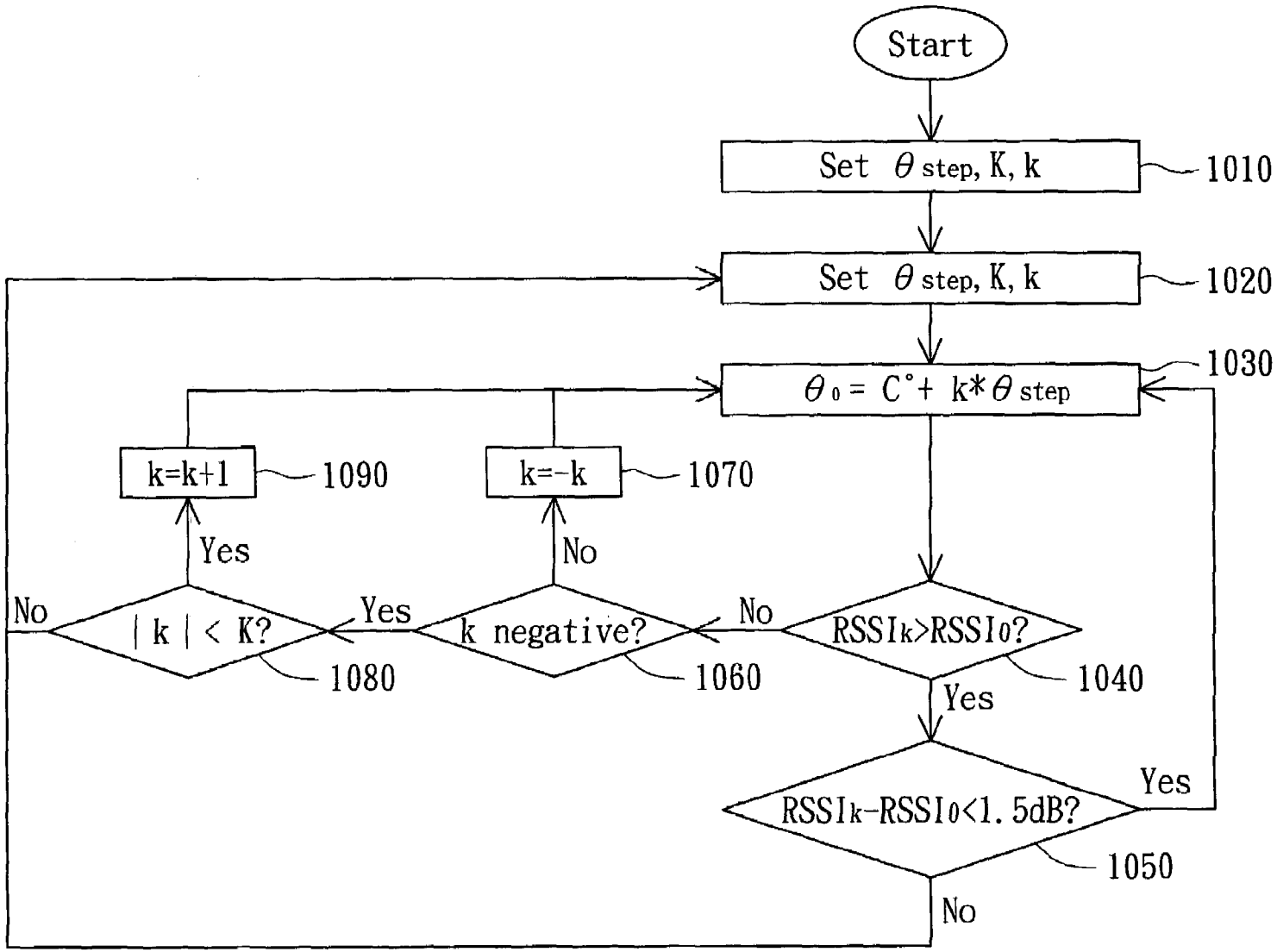
FIG. 9 shows a flow chart illustrating the sub-steps of the step 540 to fine-tune the main central angle C.

FIG. 9 shows a flow chart illustrating the sub-steps of the step 540 to fine-tune the main central angle C following the completion of step 530. For fine-tuning the location of the main central angle C, a step number K is determined in step 1010, where $$K = \frac{\left(\frac{BW}{2}\right)}{\theta_{step}} \quad (7)$$

That is, for a beam width BW=120° and a step angle $\theta_{step}$ of 5°, then K is determined from (7), and the main beam can be incrementally stepped up or down in multiples of the step angle, according to the step number K, about the main central angle C to fine-tune the main central angle C. Also, an integer k is defined, where k is an integer greater than or equal to −K, and less than or equal to +K, as illustrated in step 1010. Then, k is initially set to 1, as shown in step 1020. Thus, the location of the center of the main beam is moved to $\theta_0$ according to $\theta_0$=C+k×$\theta_{step}$. Referring back to FIG. 6, in case step angle $\theta_{step}$ is 5°, and the main central angle C is at 30°, then the main beam is stepped up to a new central angle $\theta_0$=35° (away from the θ=0° axis) in step 1030. Then, step 1040 is performed to check whether signal strength $RSSI_k$ detected at the calculated $\theta_0$ using the determined k is greater than the default signal strength $RSSI_0$ of the desired incoming signal determined during step 510 of initializing. If $RSSI_k$>$RSSI_0$, shown by step 1050, then the difference from subtracting $RSSI_k$ by $RSSI_0$ is checked if less than a default decibel value DB i.e. $RSSI_k$-$RSSI_0$≦DB. Preferably, DB=1.5 dB. If $RSSI_k$-$RSSI_0$≦DB, meaning that the client has been found and the default decibel value DB condition is satisfied, then step 1030 is returned to attempt to lock on the client, by moving the location of the center of the main beam C closely to $\theta_0$. If instead, step 1040 determines that $RSSI_k$ is not greater than $RSSI_0$, then step 1060 is performed to check whether k is negative. Then, if k is not negative, step 1070 is performed to set k=−k and step 1030 is returned so as to optimize the signal strength $RSSI_k$. Using FIG. 6 for illustration, in accordance with $\theta_0$=C+k×$\theta_{step}$, if k (=1) becomes −k, the main central angle C is instead moved (from C=35°) towards the θ=0° axisto locate the client at C=25°. However, if k is indeed negative, then step 1080 is performed to check if the client has been searched for in the entire coverage area, i.e. by checking if the absolute value of k is less than K. If not, then step 1020 is returned in attempt to re-search for the client. If the absolute value of k is less than K in step 1080, then k is incremented by 1, indicated by step 1090, and step 1030 is returned to optimize the signal strength $RSSI_k$ by moving the mainbeam to a main central angle C according to the newly incremented k.

The embodiment of the invention solves the problem when a client moves around between different locations of coverage within a coverage area. By applying the adaptive digital beamforming method, the weighting device 240 constantly adjusts the beam pattern generated by the antenna array so that the signal strength of the incoming signals relating to the client is optimized. The embodiment of the invention also provides a simpler architecture by embedding the algorithm, for calculating weight vectors, in the weighting device. Also, in adopting a digital beamforming implementation, considerable power is reduced by applying the embodiment of the invention so as described, as compared to analog beamforming configurations. With conventional analog beamforming techniques, the time taken to feedback analog signals to the MAC device usually takes considerable about of time. The embodiment of the invention solves that problem by providing fast processing, which is particularly useful in compact portable network-capable devices such as PDAs and laptop computers that require fast processing for mobility.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A wireless network apparatus, comprising:

an antenna array, having a plurality of antennae;

a transceiver for receiving a plurality of analog input signals from a client via the antennae;

a A/D converter for converting the analog input signals into digital input signals;

a weighting device for receiving and multiplying the digital input signals by a weight vector to output an digital weighted signal, comprising:

a weight generator, for generating the weight vector, which includes a plurality of weights corresponding to the digital input signals from the antenna array, wherein the weight generator further comprises:

a searching unit for determining a main central angle of one of a plurality of beams in response to the digital input signals by switching location of the plurality of beams among N different locations in a coverage area defined by the antenna array until the largest signal strength of the incoming signals is found, wherein the N different locations correspond to N number of the beams required to cover all incoming signals in the coverage area;

a radio pattern unit for determining the weight vector in response to the main central angle by looking up a predetermined table; and a track unit for fine-tuning the main central angle; and an algorithmic unit, multiplying the digital input signals by the weight vector to generate a digital weighted signal; and a MAC device connected to the weighting device for processing the digital weighted signal.

2. The wireless network apparatus of claim 1, wherein the searching unit determines the main central angle by respectively forming a plurality of beams with different central angles, calculating a signal strength of incoming signals at each beam, and choosing the central angle of the beam which has the largest signal strength of the incoming signals as the main central angle.

3. The wireless network apparatus of claim 1, wherein the track unit fine-tunes the central angle by further detecting a signal strength of incoming signals.

4. An adaptive digital beamforming method, for adjusting an antenna array, the method comprising:

searching a main central angle C by respectively forming a plurality of beams with different central angles, calculating a signal strength of incoming signals at each beam, and choosing the central angle C of the beam which has the largest signal strength as the main central angle, wherein the step of searching the main central angle comprises switching location of the plurality of beams among N different locations in a coverage area defined by the antenna array until the largest signal strength of the incoming signals is found, wherein the N different locations correspond to N number of the beams required to cover all incoming signals in the coverage area;

determining a weight vector in response to the main central angle C by looking up a predetermined table;

fine-tuning the main central angle C by detecting a signal strength of incoming signals; and forming a main beam according to the fine-tuned main central angle and the weight vector.

5. The method according to claim 4, wherein the step of fine-tuning comprises adjusting the main central angle C such that the fine-tuned main central angle C further approaches an incident angle $\theta_0$ of the desired incoming signal.

6. The method according to claim 4, wherein N is determined by dividing a surface angle by a beam width BW.

7. The method according to claim 6 wherein the surface is a plane, whereby the surface angle is 180 degrees and N is 180/BW.

8. The method according to claim 7, wherein the surface having a positive horizontal axis being at +P degrees, a negative horizontal axis being at −P degrees, the positive vertical axis being at 0 degrees, the central angle C of the main beam is determined by $$C = P - (n+1) \times \frac{BW}{2},$$

wherein $n \leqq (N-1)$.

9. The method according to claim 8, wherein P is 90 degrees.

10. The method according to claim 8, wherein BW is 120 degrees.

11. The method according to claim 4, wherein the step of determining a main central angle C comprises:

(a). identifying a client MAC ID associated with the desired incoming signal via substantially filtering out the incoming signals that are undesired;

(b). determining value for N from dividing the beam width, determined during the step of initializing, by the surface angle;

(c). setting initial value for n to 1, wherein $n \leqq (N-1)$;

(d). calculating the central angle $$C = P - (n+1) \times \frac{BW}{2},$$

and moving the central angle C of the main beam to the calculated central angle C;

(e). checking whether the signal strength of the incoming signals detected at the calculated central angle C, using the determined n, is greater than the default signal strength of the desired incoming signal;

(f). checking whether n is less than N if the signal strength of the incoming signals detected at the calculated central angle C is not greater than the default signal strength of the desired incoming signal, else proceeding to the step of determining a weight vector in response to the main central angle;

(g). incrementing n by 1 if n is less than N, else returning to step (c); and (h). returning to step (d) to calculate a new central angle C of the main beam using the incremented n, and moving the central angle C of the main beam to the new central angle C.

12. The method according to claim 4, wherein the step of determining a weight vector comprises:

updating amplitudes a's of the individual beams corresponding to respective antennae of the antenna array in response to the largest signal strength RSSI located during the step of determining a main central angle C;

updating phases θ's in response to the desired incoming signal located during the step of switching location of the main beam; and shaping up the plurality of beams of the respective antennae of the antenna array using the weight vector by applying appropriate phase shifting and amplitude scaling using θ's and a's, respectively.

13. The method according to claim 4, wherein the step of fine-tuning the main central angle comprises:

(j). determining a step number K, wherein $$K = \frac{\left(\frac{BW}{2}\right)}{\theta_{step}},$$

for fine-tuning the location of the central angle C;

(k). determining k, wherein k is an integer greater than or equal to −K, and less than or equal to +K;

(l). setting k=1;

(m). moving the location of the center of the main beam to the incident angle $\theta_0$, wherein $\theta_0=C+k\times\theta_{step}$;

(n). checking whether signal strength ($RSSI=RSSI_k$) detected at the calculated $\theta_0$ using the determined k is greater than the default signal strength $RSSI_0$ of the desired incoming signal determined during the step of initializing;

(o). checking whether the difference in subtracting $RSSI_k$ by $RSSI_0$ is less than a default decibel value DB ($RSSI_k-RSSI_0<DB$) in case when $RSSI_k>RSSI_0$;

(p). returning to step (l) to attempt to lock on the network client by moving the location of the center of the main beam C to $\theta_0$ if $RSSI_k-RSSI_0\leqq DB$;

(q). checking if k is negative;

(r). setting k=−k and returning to step (in) to optimize the signal strength $RSSI_k$, if k is not negative;

(s). checking if the absolute value of k is less than K, and returning to step (l) to research for the network client if the absolute value of k is not less than K; and (t). incrementing k by 1 and returning to step (m) to optimize the signal strength $RSSI_k$ if the absolute value of k is less than K.

14. The method according to claim 13, wherein the default decibel value DB is 1.5 decibels.

* * * * *